US006480672B1

(12) United States Patent
Rosenzweig et al.

(10) Patent No.: US 6,480,672 B1
(45) Date of Patent: Nov. 12, 2002

(54) FLAT PANEL HEATER

(75) Inventors: Stan Rosenzweig, Brookline; Jaideep Jayaram, Milford, both of MA (US)

(73) Assignee: Holmes Group, Inc., Milford, MA (US)

( * ) Notice: Subject to any disclaimer, the term of this patent is extended or adjusted under 35 U.S.C. 154(b) by 0 days.

(21) Appl. No.: 09/801,099

(22) Filed: Mar. 7, 2001

(51) Int. Cl.[7] ..... F24H 3/00

(52) U.S. Cl. ..... 392/365; 392/435; D23/332

(58) Field of Search ..... 392/365–369, 392/363, 360, 435, 438, 439, 432; D23/332, 335, 341, 317; 219/476–478, 537, 539, 255; 338/293, 290, 292, 287

(56) References Cited

U.S. PATENT DOCUMENTS

| | | | | | |
|---|---|---|---|---|---|
| 1,416,481 | A | * | 5/1922 | Longoria | 219/528 |
| 1,534,542 | A | * | 4/1925 | Reimers et al. | 219/255 |
| 1,565,539 | A | * | 12/1925 | Woodson | 392/435 |
| 2,596,327 | A | * | 5/1952 | Cox et al. | 392/485 |
| 2,715,668 | A | * | 8/1955 | Booker et al. | 392/374 |
| 2,829,452 | A | * | 4/1958 | Humphrey | 219/255 |
| 2,978,568 | A | * | 4/1961 | Murphy | 392/360 |
| 2,984,728 | A | * | 5/1961 | Murphy | 392/360 |
| 3,020,384 | A | * | 2/1962 | Murphy | 392/360 |
| 3,215,828 | A | * | 11/1965 | Bonvallet | 392/365 |
| 3,691,345 | A | * | 9/1972 | Needham et al. | 392/436 |
| 3,767,895 | A | * | 10/1973 | Needham | 392/435 |
| 3,855,450 | A | * | 12/1974 | O'Connor | 392/374 |
| 3,985,295 | A | * | 10/1976 | Monninger | 392/365 |
| D281,526 | S | * | 11/1985 | Cenefels | D23/335 |
| 5,415,934 | A | | 5/1995 | Mori | |
| 5,592,647 | A | | 1/1997 | Yamauchi et al. | |
| 5,624,591 | A | | 4/1997 | Di Trapani | |
| 6,134,386 | A | | 10/2000 | O'Donnell | |
| D450,818 | S | * | 11/2001 | Schnakenberg, III et al. | D23/332 |

FOREIGN PATENT DOCUMENTS

| | | | |
|---|---|---|---|
| FR | 2616289 | * 12/1988 | |
| GB | 786577 | * 11/1957 | 392/363 |
| GB | 2255262 | * 10/1992 | |

* cited by examiner

*Primary Examiner*—John A. Jeffery
(74) *Attorney, Agent, or Firm*—Hoffman & Baron, LLP; Francis E. Marino

(57) ABSTRACT

A heater includes a housing having an outer surface and sidewalls defining an interior space that holds a heating element. The heater further includes a heating element having a lower portion and an upper portion, where the heating element has differing power densities from the lower portion to the upper portion. The heating element includes a heat shield positioned in substantially parallel relation to the heating element to create a duct where air may travel through. The heater is provided with an air displacement device positioned adjacent to the heating element to create a planar flow of air through the duct. The heater may be controlled by a control circuit having a circuit board, which controls the power supplied to the heating element and the air displacement device.

23 Claims, 5 Drawing Sheets

FLAT PANEL HEATER

BACKGROUND OF THE INVENTION

1. Field of the Invention

The present invention relates to a portable electric heater, and more particularly to a improved flat panel heater having a flat panel heating element with a plurality of heating zones creating an efficient heating utilizing a planar air flow over the heating element.

2. Description of the Prior Art

Portable electric heaters are commonly used in many offices and households. Portable electric heaters in general are well known in the art and commonly used. Prior designs of heaters typically involve using a forced air system where a heating coil or other resistance type wire is used to supply heat after a current is passed through it. A fan is located adjacent the heating coil to blow air over the heated coil, thereby warming the air.

U.S. Pat. No. 5,655,055 to Goldstein et al. discloses a heater having a cylindrical housing with a fan blade positioned on the bottom of the housing below a heating element. Goldstein et al. discloses that the fan will blow air upward in a forced manner past the heating element through the housing and then through vents out of the housing. The air would become heated by passing over the heating element.

However, one disadvantage of heaters designed in this manner is that the heating element must become extremely hot in order to sufficiently heat the air moving past it, since the air is only passing over the heating element for a brief period of time. In addition, another disadvantage to this design is that the forced air from the fan may not flow evenly over the heating element, therefore the heating element is not cooled at an even rate creating an inefficient heater.

To address both problems, flat panel heaters have been created to provide a more even heat flow from the heating element itself. These flat panel heaters are typically shaped in large rectangular shapes and are heated so that the air immediately adjacent to the flat panel heater is heated. U.S. Pat. No. 6,134,386 to O'Donnell discloses a flat panel heater. The heater disclosed has a plurality of coils running beneath the surface of the flat panel heater which heats the top surface of the flat panel heater. The heating coils underneath the top surface heat the entire top of the flat panel heater thereby increasing the amount of air that is warmed immediately adjacent to the heater. One disadvantage of this design is that the flat panel heater only heats the air which is immediately adjacent to the flat panel heater itself, thus should the air be stagnant, very little volume of air is heated.

Therefore, in view of the prior art it would be desirable to have a heater which efficiently and evenly cools the heating element.

It would further be desirable to have a portable electric heater which creates an even flow of warm air being discharged from the unit.

OBJECTS AND SUMMARY OF THE INVENTION

It is an object of the present invention to provide a heater having an efficient heating element.

It is an object of the present invention to provide a flat panel heater having a heating element with a plurality of heating zones.

It is another object of the present invention to provide a heater having a planar and homogeneous air flow to provide even cooling of the heating element.

According to the heater of the present invention, the heater includes a housing having sidewalls defining an interior space that holds a heating element. The heating element is preferably in the form of a flat panel having a lower portion and an upper portion, wherein the heating element has differing power densities from the lower portion to the upper portion. The heater also includes a heat shield positioned in substantially parallel relation to the heating element to create a duct for directing air flow therethrough. To move the air over the heating element, the heater is provided with an air displacement device positioned adjacent to the heating element providing a planar flow of air through the duct. The heater may be controlled by a control circuit having a circuit board, which controls the power supplied to the heating element and the air displacement device.

In the preferred embodiment of the present invention, the air displacement device is a fan having a fan housing holding a motor connected by a shaft to at least one fan blade rotatably mounted to the motor. The fan housing may have an outlet directed toward the duct and an inlet for drawing air into the fan. The fan preferably uses a first squirrel cage fan blade positioned in linear alignment with a second squirrel cage fan blade so that a single motor may be used to rotate both fan blades. The squirrel cage fan blade is positioned so that air exiting the fan is directed into the duct. Some of the air may flow over the front face of the heating element opposite the duct.

The heating element is preferably made of a heat conductive material such as steel and is substantially flat and has a rectangular shape. The heating element is preferably positioned in a substantially vertical orientation within the heater housing and the axis of rotation of the fan blade is substantially perpendicular to the longitudinal axis of the heating element. The heating element may use an electrical resistance element which is attached to the heating element to create the power density. The electrical resistance element is preferably a continuous resistance wire made of an electrically conductive material, such as copper, that releases heat when a current is passed through it. The continuous resistance wire may be positioned on the heating element in an "S" curve configuration so that the element is spaced closer to itself on the lower portion of said heating element and is spaced a distance further apart on the upper portion of the heating element, thereby creating differing heating zones in the heating element. Preferably there is a first resistance wire and a second resistance wire positioned in parallel relationship to each other and power to the heating element is controlled by the electronic control circuit.

An advantage of the present invention is that the heating element has differing different heating zones thereby increasing the output efficiency of the heater. The bottom of the heating element is heated at a higher rate so that the high speed air at ambient temperature drawn in by the fan and directed over the heating element will be heated quickly by the higher power heating element portion at the lower end of the heating element. After passing over the lower portion, the now slower moving air passes over the upper portion and will stay in contact with the heating element a longer amount of time than it did at the lower portion. Therefore, the upper portion does not have to be as hot as the lower portion to sufficiently heat the air. The air will then pass over the upper portion and flow out of the duct into the space to be heated.

A further advantage of the present invention is that the air which exits the fan is directed in a substantially planar manner over the heating element so that its surface is cooled at a substantially even rate. The combination of the duct and the varying power density of the heating element create an environment where the heating element is cooled in a homogenous and even rate.

In order to provide a safer heater, the preferred embodiment of the present invention includes a control circuit having a circuit board controlling the current supplied to the heating element and the motor. The control circuit may include a current limiting sensor and a thermister to both prevent the heating element from over-heating and limit the amount of heat produced by the heater. The circuit board also includes a power light to alert the user when the heater is activated. In addition, a tip over switch may be mounted to heater, so that if the heater were to tip over, it would automatically shut off the fan and the heating element.

A preferred form of the portable electric heater, as well as other embodiments, objects, features and advantages of the present invention will be apparent from the following detailed description of illustrative embodiments thereof, which will be read in conjunction with the accompanying drawings.

DETAILED DESCRIPTION OF THE INVENTION

Figure 1:
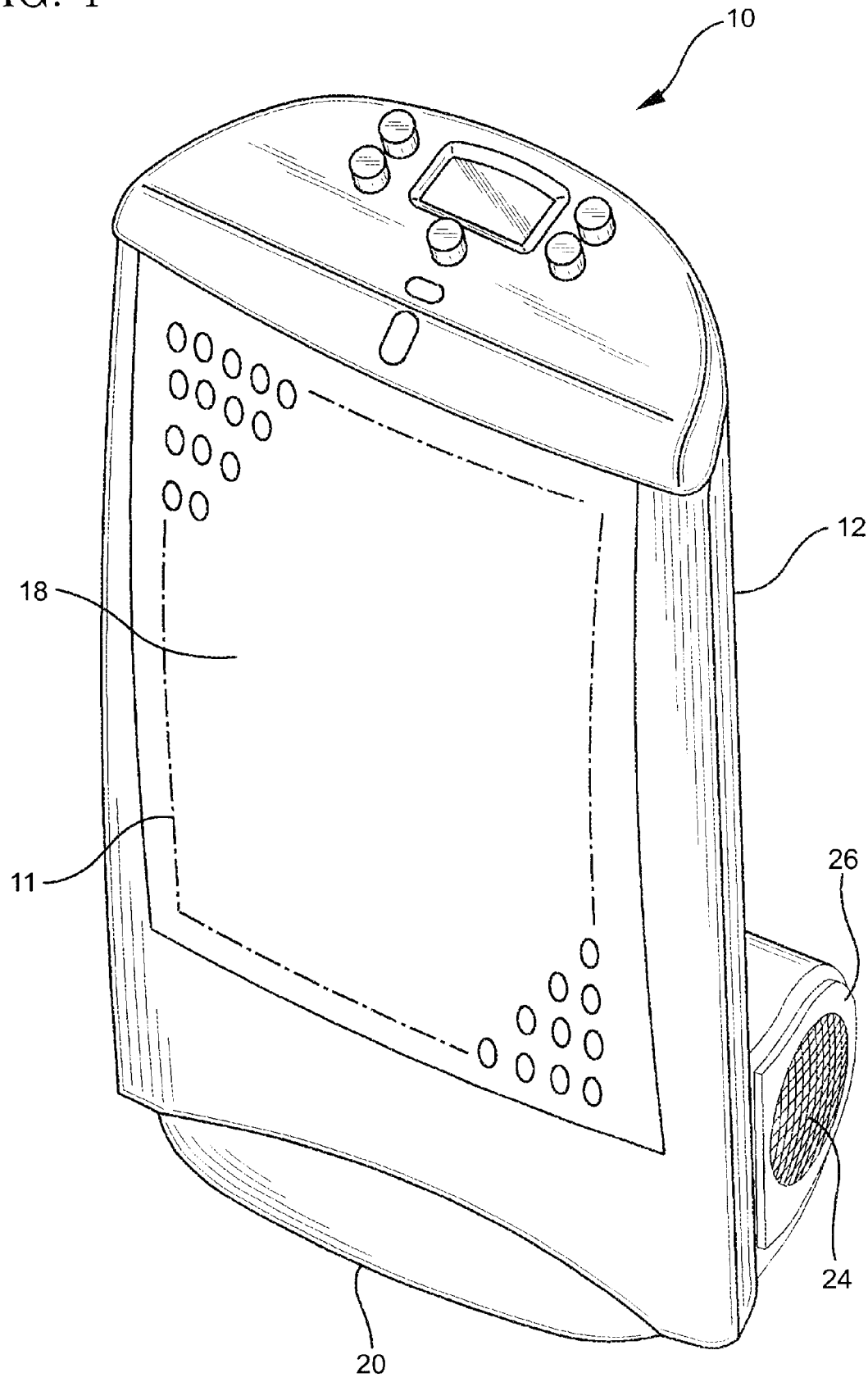
FIG. 1 is a top perspective view of the present invention.
Figure 2:
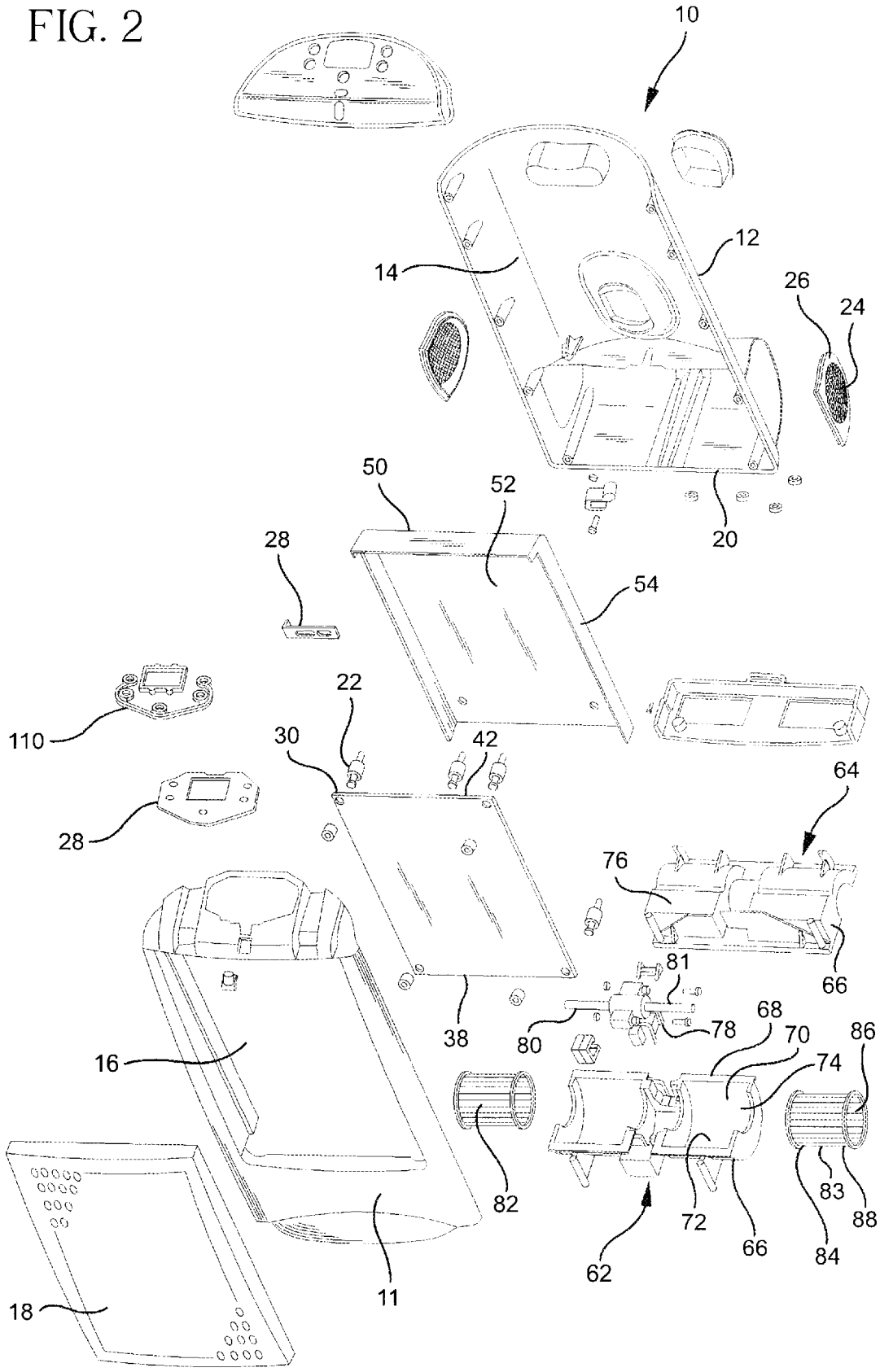
FIG. 2 is an exploded perspective view of the present invention.
Figure 3:
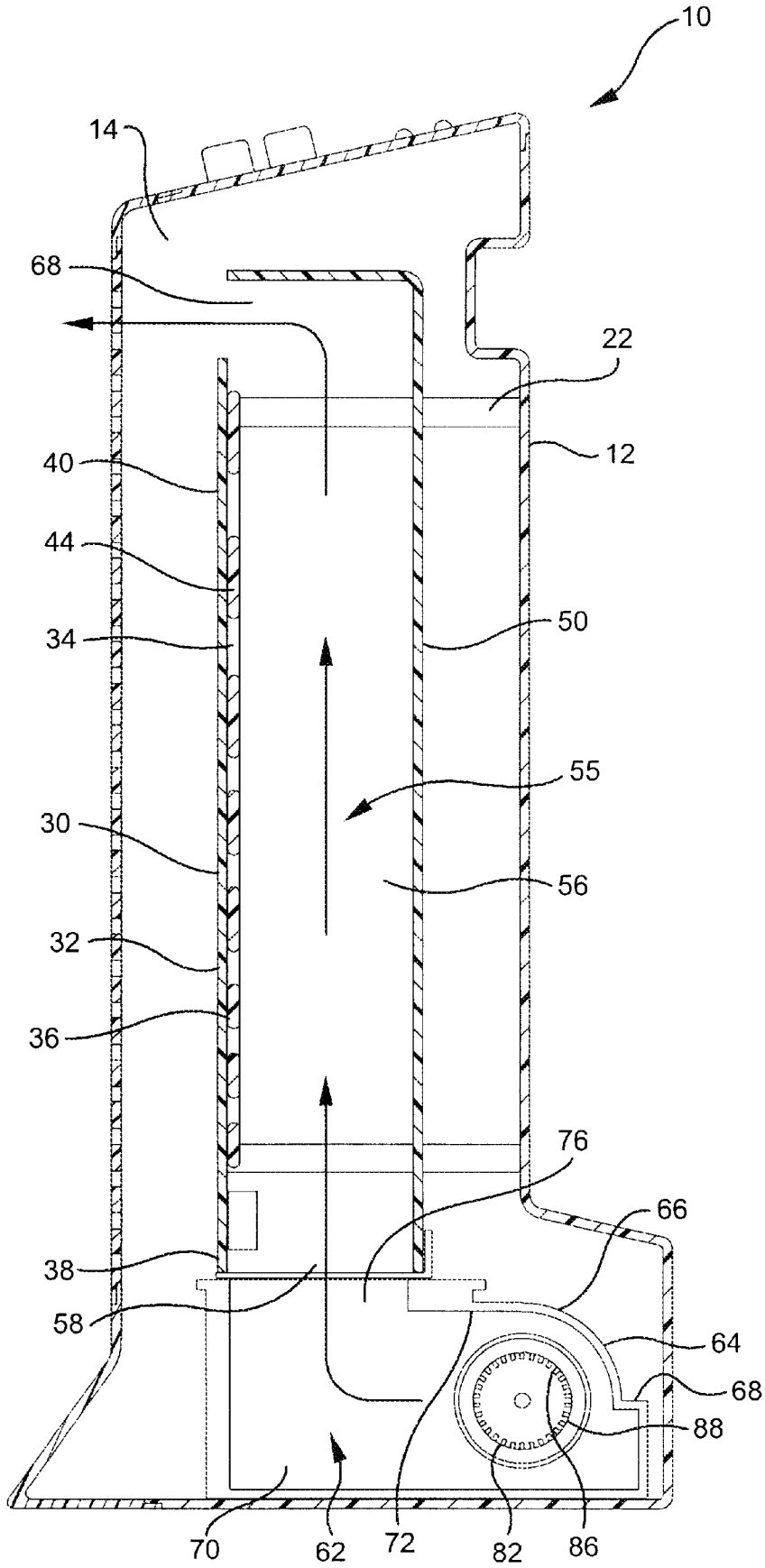
FIG. 3 is a cross-section of the present invention taken along line 3—3 of FIG. 1.

As illustrated in FIGS. 1–3, a portable electric heater 10 formed in accordance with the present invention includes a housing 12 having a free standing base 20, a heating element 30 which is supported by the housing 12 and an air displacement device 62 for moving air over to the heating element 30. The housing 12 is preferably hollow having an interior space 14 with mounting braces 22 for supporting the heating element 30 inside the housing 12. In the preferred embodiment, the heating element 30 has a substantially flat panel configuration in a rectangular shape. The flat panel heating element 30 may be positioned in the housing 12 so that the longitudinal axis of the heating element 30 is in a substantially vertical position with the air displacement device 62 positioned below the heating element 30.

The flat panel heating element 30 may be attached to the housing 12 using a plurality of mounting braces 22. In the preferred embodiment the mounting braces 22 are made of a heat resistant material, and may comprise a series of posts which are attached to the four corners of the rectangular heating element 30. The heating element 30 is preferably positioned so that its longer dimension or its longitudinal axis is in a substantially vertical position. It is contemplated, however, that the flat panel heating element could also be oriented in a horizontal manner. In such an embodiment, the management of the heating element could also be re-oriented so that a higher power density is provided at a lower portion of the heating element closest to the fan.

In the preferred embodiment, positioned behind the heating element 30 in substantially parallel thereto is a heat shield 50 having a similar size and shape to the flat panel heating element 30 and creating an air space 55 therebetween. More specifically, the heat shield 50 is positioned spaced from the heating element to form a duct 56 which air may flow through. The heat shield 50 may be made of a metallic material or any other material which reflects heat. The heat shield 50 of the preferred embodiment has a back portion 52 with two sidewalls 54 extending substantially perpendicular from the back portion 52. Preferably the sidewalls 54 terminate in close proximity to or may contact the heating element 30 thereby creating the duct 56. The duct 56 has a duct inlet 58 defined by the lower edge 38 of the heating element 30 and the heat shield 50, and a duct outlet 60 defined by the upper edge 42 of the heating element 30 and heat shield 50. The heat shield 50 forming the duct 56 is directed toward the front of the housing after it reaches the upper edge 42 of the heating element 30. The duct 56 is then connected to an opening 16 on the front face 11 of the housing 12 to complete the duct outlet 60.

An air displacement device 62 is preferably positioned below the heating element 30. In the preferred embodiment the air displacement device 62 is a fan assembly 64 having a fan housing 66 with an interior space 70 defined by an outer sidewall 68, a motor 78 positioned in the fan interior space 70 and at least one fan blade 82 rotatably connected to a shaft of the motor 78. The fan housing 66 is used to add structural rigidity to the fan assembly 64 and to direct the flow of air created by the fan assembly 64. The fan housing 66 may have a fan inlet opening 74 which corresponds to a inlet opening 24 on the side wall 26 of the heater 10 to allow air to flow into the fan assembly 64, and a fan housing outlet 76 where the fan assembly 64 then expels the air. The fan outlet 76 is preferably positioned below the duct inlet 58 so that air exiting the fan outlet 76 may blow air into the duct 56 so that it may then travel up through the duct 56 and over the surface of the flat panel heating element 30 to the duct outlet 60. Preferably, the majority of the air exiting the fan outlet 76 will be directed into the duct 56, however, it is envisioned that some of the air exiting the fan outlet 76 will travel up the front surface 32 of the heating element 30 opposite the duct 56.

Referring to FIG. 1, the present invention preferably has a motor 78 positioned in the center of the fan interior space 70. The motor 78 preferably has a first shaft 80 and a second shaft 81 extending outward from the motor 78 connected to a first 82 and second fan blade 83 positioned on opposite sides of the motor 78 in linear alignment with each other. In the preferred embodiment, the fan blades are squirrel cage fan blades 84 which are positioned inside the fan interior space 70. Squirrel cage fan blades 84 typically have a cylindrical configuration with an inner surface 86 and an outer surface 88. Air enters the inner surface 86 of the squirrel cage fan blade 84 as it is rotating and is then displaced in a outward direction from its axis of rotation past the outer surface 88 of the squirrel cage fan blade 84. The fan outlet 76 is preferably positioned on the top of the fan housing 66 to direct the air from the squirrel cage fan blade 84 into the duct inlet 58. The fan interior space 70 may have an inner surface 72 which is contoured to follow the outer surface 88 of the squirrel cage fan blade 84 so that the air displaced by the fan blade 82 is directed toward the fan outlet 76 and into the duct 56. The axis of rotation of the fan blades 82 is preferably substantially perpendicular to the longitudinal axis of the heating element 30 to further focus the air to flow over evenly over the heating element 30.

An advantage to using the squirrel cage fan blades 84 in the present invention is that the air flow upon exiting the fan housing 66 is substantially focused creating a planar and homogeneous air flow over the heating element 30 thereby increasing the heater's efficiency.

The heating element 30 is preferably made of a heat conductive material. In the preferred embodiment the heating element 30 is made from a sheet of rectangular steel which is positioned vertically inside of the housing 12. The heating element 30 has a front surface 32 and a back surface 34 and a lower portion 36 delimited by a lower edge 38 and an upper portion 40 delimited by an upper edge 42. In the preferred embodiment, the heating element 30 uses an electrical resistance element 44 positioned on the surface of the heating element 30 that allows that the power density of the heating element 30 to be greater on the lower portion 36 than on the upper portion 40 of the heating element 30. The increased power density on the lower portion 36 of the heating element 30 causes the lower portion 36 to be heated to a higher temperature than the upper portion 40 of the heating element 30. The electrical resistance element 44 is preferably made of an electrically conductive material such as a cooper so that when an electrical current is passed through the electrical resistance element 44, heat will be released.

Figure 4:
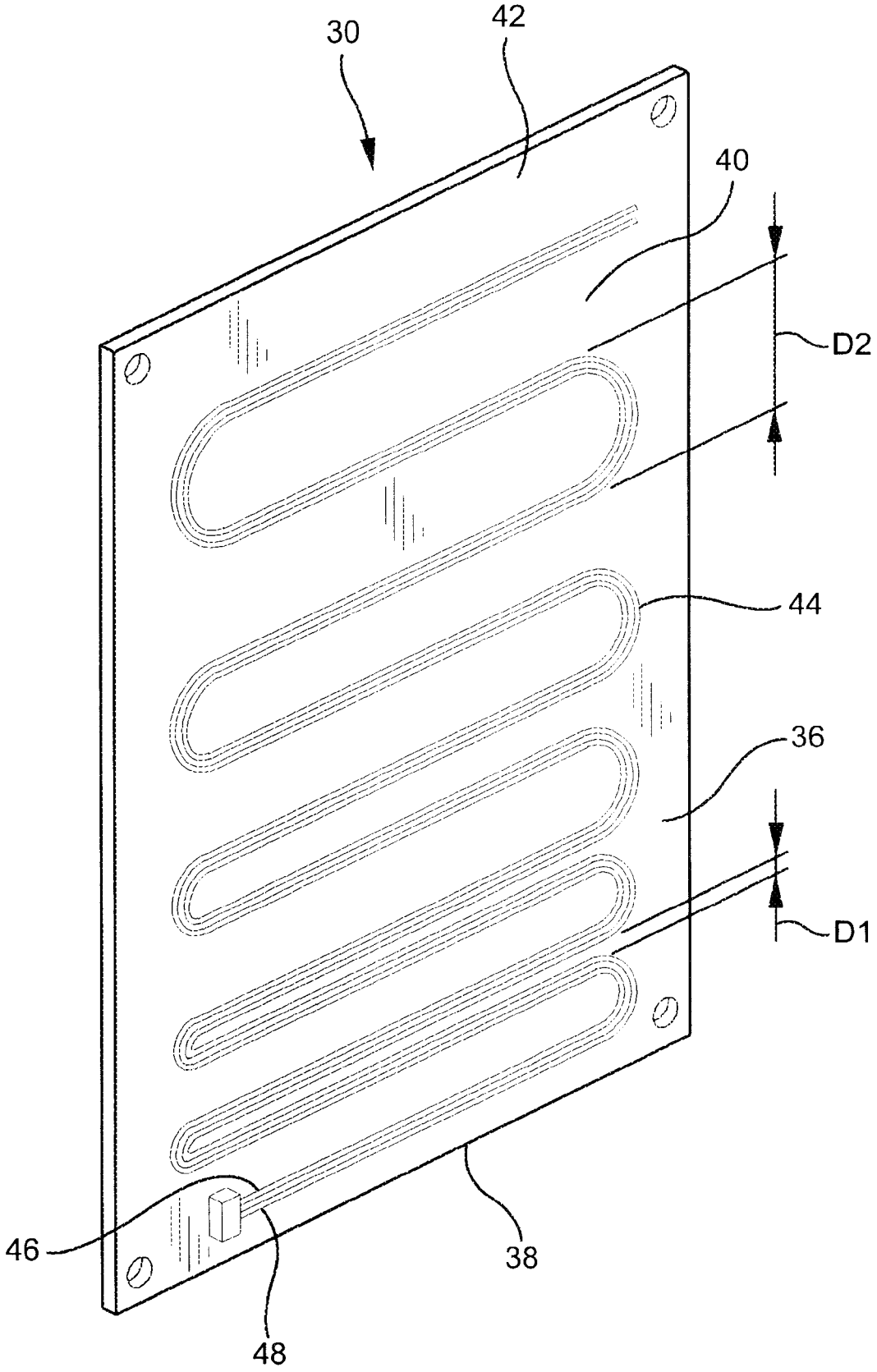
FIG. 4 is a top perspective view of the heating element.

Referring to FIG. 4, the electrical resistance element 44 for the present invention is preferably made of a continuous wire or electrical trace used in the formation of printed circuit boards which runs from the lower portion 36 of the heating element 30 to the upper portion 40 of the heating element 30. The wire or trace is preferably attached to the back surface 34 facing the inside of the duct 56 created by the heating element 30 and the heat shield 50. The electrical resistance element 44 is preferably positioned on the heating element 30 so that it runs in a substantially horizontal position on the heating element 30 and continues up the heating element 30 in a "S" type configuration to the top of the heating element 30. The power density of the electrical resistance element 44 is varied by having the individual "S" curves of the resistance element placed in a close parallel relationship, distance D1, to each other on the lower portion 36 of the heating element 30. The "S" curves of the wires are gradually spaced farther away from each other as the wire is positioned higher on the heating element 30, distance D2, thereby decreasing the power density on the upper portion 40. In the preferred embodiment there will be two parallel wires, namely, a low heat element 46 and a high heat element 48 positioned next to each other following the same path so that should the user wish to increase the amount of heat produced by the heating element 30 when the low heat element 46 is activated, the high heat element 48 may be activated to create a higher power density to create more heat.

One of the advantages of the present design is that the heating element 30 has at least two different heating zones to further increase the efficiency of the heater. It is contemplated that more than two power densities may be formed on the heating element to achieve even greater efficiency of operation. The bottom of the heating element 30 is heated at a higher rate so that the high speed air at ambient temperature which is immediately exiting the fan assembly 64 will be heated quickly by the higher heat at the lower portion 36 of the heating element 30. As the air passes over the lower portion 36, it will be heated and then travel upward to the upper portion 40 of the heating element 30.

After passing over the lower portion 36, the air will then pass over the upper portion 40 of the heating element 30. The air will be moving slower over the upper portion 40 since it is now a further distance away from the fan assembly 64 and will stay in contact with the heating element 30 a longer amount of time than it did at the lower portion 36 of the heating element 30. The heating element upper portion 40 does not have to be as hot as the lower portion 36 to sufficiently heat the air, since the air will stay in contact longer with the upper portion 40. The air will then pass over the upper portion 40 of the heating element 30 and flow out of the duct outlet 60 to the front of the heater.

An advantage of using a heat shield 50 behind the heating element 30 is that the air which passes through the duct 56 is directed to travel straight through the duct 56 thereby increasing the amount of time the air contacts the heating element 30. The heat shield 50 also provides insulation against the heat escaping out of the air directing its travel through the duct. Another advantage of the present invention is that the air which exits the fan assembly 64 is directed in a substantially planar manner over the entire heating element 30 so that its surface is cooled at a substantially even rate. Preferably the majority of the air passes through the duct 56, however, it is envisioned that some air may flow over the front surface 32 of the heating element 30. Although, the air which is flowing past the front face surface 32 of the heating element 30 is not directed in the same manner as the air through the duct 56, it will nevertheless assist in evenly cooling the heating element 30. The combination of the duct 56 and the varying power density of the heating element 30 create a heater 10 with a heating element 30 that is cooled in a homogenous and even rate.

The housing 12 of the heater 10 is preferably constructed so that the front face 11 has an opening 16 which is positioned in front of the heating element 30. In the preferred embodiment, the opening has a rectangular shape that is the same size as the heating element 30. The opening in the front face of the housing may have a grill covering 18 with a plurality of holes in it so that air which flows over the front face of the heating element 30 may be allowed to exit out the front of the housing. The air exiting the duct outlet 60 preferably flows out of a top portion 15 of the grill covering 18. The air inlets for the fan 24 are preferably positioned on the sidewalls 26 of the housing 12 and are perforated grills which allow air to freely flow through. The air inlets 24 on the sidewalls 26 are preferably positioned over the squirrel cage fan blades 84, thus the fan blades 84 can draw air through the air inlets 24 into the center of the fan blade 84 and then push the air to the outer surface 88 of the fan blade 84 and through the fan housing outlet 76.

Figure 5:
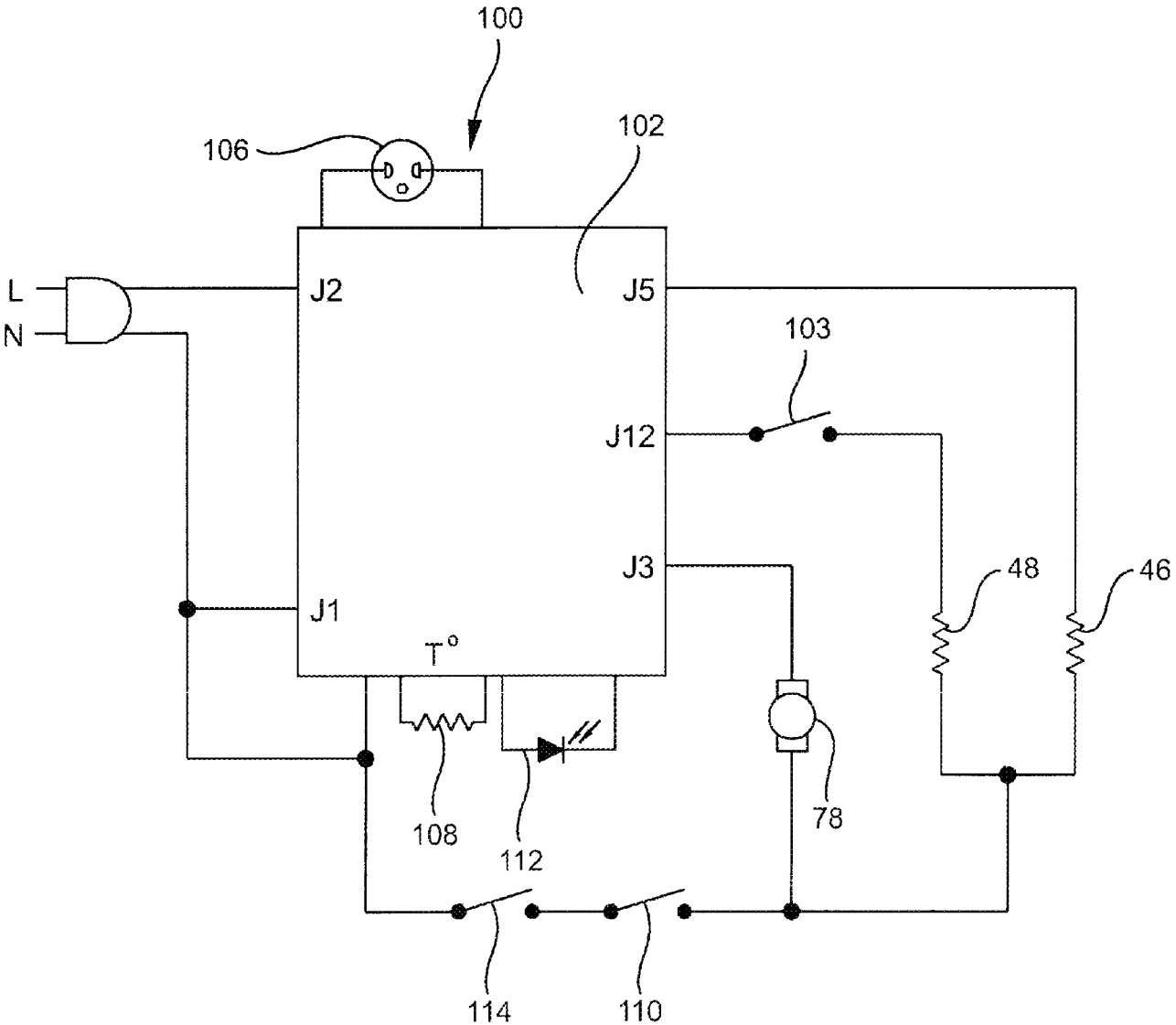
FIG. 5 is a circuit schematic for the present invention.

The heating element 30 may be controlled by a control circuit 100 as shown in FIG. 5. The control circuit 100 may include a printed circuit board 102 to control the current supplied to the low heat element 46 and the high heat element 48. Preferably the printed circuit board 102 may include a microprocessor. The low heat element 46 and the high heat element 48 are preferably connected in parallel to each other and may be independently controlled by the circuit board 102 independent of each other. A current limiting sensor 103 may be used in conjunction with high heat element 48 to prevent the high heat element 48 from over heating. The circuit board 102 may also control the motor 78 of the fan assembly 64 and may include a power light 106 to alert the user that the heater is activated. Referring to FIGS. 2 and 5, a thermister 108 may be attached to the heating element 30 to regulate the amount of heat that is produced by the heater 10. Thermisters 108 are well known to those of ordinary skill in the art and do not need to be described in detail. The control circuit 100 may also include a photodiode 112 and a PTC switch 114 which are well known in the art. In addition, a tip-over switch 110 may be internally mounted to the heat shield 50 by a mounting bracket 28 such that if the heater 10 were to tip over, it would automatically shut off the fan assembly 64 and the heating element 30.

Although the illustrative embodiments of the present invention have been described herein with reference to the accompanying drawings, it is to be understood that the invention is not limited to those precis embodiments, and the various other changes and modifications may be effected therein by one skilled in the art without the departing from the scope or spirit of the invention.

What is claimed is:

1. A portable electric heater comprising:

a housing having an interior space;

a flat panel heating element oriented in a substantially vertical plane and having a vertical axis associated therewith; and a fan assembly, said fan assembly including a motor having a shaft attached to a fan blade, wherein the axis of rotation of the fan blade is substantially perpendicular to said vertical axis of the flat panel heating element and further wherein said axis of rotation of said fan blade is in substantially parallel plane to said vertical plane of said flat panel heating element.

2. A portable heater as defined in claim 1, wherein said fan assembly further includes a first squirrel cage fan blade positioned in linear alignment with a second squirrel cage fan blade, said second squirrel cage fan blade being rotatably mounted on an opposite side of said motor than the first squirrel cage fan blade.

3. A portable heater as defined in claim 2, wherein said flat panel heating element is positioned in said interior space of said housing, said heating element having a front face and a back face, and a lower portion and an upper portion, said heating element having differing power densities from the lower portion to the upper portion; and a heat shield positioned in substantially parallel relation to said heating element, whereby air travels through a duct formed by said heating element and said heat shield, said duct having a duct inlet and a duct outlet.

4. A portable heater as defined in claim 3, wherein said fan assembly creates a planar flow of air which travels adjacent said heating panel in said duct.

5. A portable heater as defined in claim 4, wherein said flat panel heating element includes at least a first portion having a first power density and a second portion having a second power density.

6. A portable heater comprising:

a housing having an outer surface and sidewalls defining an interior space;

a flat panel heating element positioned in said interior space of said housing and oriented in a substantially vertical plane, said heating element having a front face and a back face, and a lower portion and an upper portion, said heating element having differing power densities from the lower portion to the upper portion;

a heat shield positioned in substantially parallel relation to said heating element, whereby air travels through a duct formed by said heating element and said heat shield, said duct having a duct inlet and a duct outlet;

an air displacement device positioned adjacent to said heating element, said air displacement device creating a planar flow of air which travels adjacent and substantially parallel to said vertical plane of said heating panel in said duct, said air displacement device comprising a fan assembly including a motor having a shaft attached to a fan blade, wherein the axis of rotation of the fan blade is substantially perpendicular to said vertical axis of the flat panel heating element and further wherein said axis of rotation of the fan blade is in a substantially parallel plane to said vertical plane of said flat panel heating element; and a control circuit electrically coupled to the heating element to control power supplied to said heating element and said air displacement device.

7. A portable heater as defined in claim 6, wherein said fan assembly further includes:

a fan housing having an outer sidewall defining a fan interior space;

a motor positioned in said fan interior space; and at least one fan blade rotatably mounted to said motor by a shaft.

8. A portable heater as defined in claim 7, wherein said at least one fan blade is a squirrel cage fan blade, said squirrel cage fan blade having an inner and an outer surface.

9. A portable heater as defined in claim 8, wherein said fan housing further includes an interior surface, said interior surface is shaped to closely follow the outer surface of said squirrel cage fan blade.

10. A portable heater as defined in claim 9, wherein said fan housing has an inlet to allow air to flow into said inner surface of said squirrel cage fan blade, and a fan outlet positioned on a top surface of said fan housing to expel air from said fan housing.

11. A portable heater as defined in claim 7, wherein said fan further includes a first squirrel cage fan blade positioned in linear alignment with a second squirrel cage fan blade, said second squirrel cage fan blade being rotatably mounted on an opposite side of said motor than the first squirrel cage fan blade.

12. A portable heater as defined in claim 7, wherein the axis of rotation of said fan blade is substantially perpendicular to a longitudinal axis of said flat panel heating element.

13. A portable heater as defined in claim 12, wherein an electrical resistance element is attached to said heating element to create said power density.

14. A portable heater as defined in claim 13, wherein said electrical resistance element is at least one continuous resistance wire attached to said heating element.

15. A portable heater as defined in claim 13, wherein said at least one continuous resistance wire is positioned on said back surface of said heating element in an "S" curve configuration.

16. A portable heater as defined in claim 15, wherein said "S" curve configuration of said at least one continuous resistance wire is spaced closer to each other on the lower portion of said heating element and are spaced a distance further apart on the upper portion of said heating element.

17. A portable heater as defined in claim 16, wherein said electrical resistance element has a first resistance wire and a second resistance wire, said first and second resistance wire being positioned adjacent to each other and arranged in parallel electrical relationship.

18. A portable heater as defined in claim 17, wherein said heater further includes an electrical control circuit including:

a circuit board;

a thermistor attached to said heating element and controlled by said circuit board;

a tip over switch connected to said housing, wherein the electric current to said heating element and said fan will be terminated should the heater activate said switch.

19. A portable heater as defined in claim 6, wherein said fan assembly is positioned so that air exiting the fan outlet is directed into said duct inlet and a portion of the air exiting the fan outlet will be directed to flow over the front face of said heating element.

20. A portable heater as defined in claim 6, wherein said heating element has a substantially rectangular shape having a longitudinal axis.

21. A portable heater as defined in claim 20, wherein said longitudinal axis of said heating element is positioned in a substantially vertical position in said housing.

22. A portable heater comprising:

a housing having an outer surface and sidewalls defining an interior space;

a flat panel heating element positioned in said interior space of said housing, such heating element having a front face and back face and a lower portion and a upper portion, said heating element having different power densities from the lower portion to the upper portion and said front surface and said back surface of said heating panel defining a vertical plane and having a vertical axis associated therewith;

a heat shield positioned in substantially parallel relation to said heating element, whereby air travels through a duct formed by said heating element and said heat shield, said duct having a duct inlet and a duct outlet;

an air displacement device positioned adjacent to said heating element, said air displacement device creating a planar flow of air which travels adjacent and substantially parallel to said first plane of said heating element in said duct, wherein said air displacement device is a motor having a fan blade wherein an axis rotation of said fan is positioned perpendicular to the vertical axis of said heating element and said axis of rotation is in substantially parallel plane as said vertical plane of said flat panel heating element; and a control circuit electrically coupled to the heating element to control power supplied to said heating element and said air displacement device.

23. A portable heater comprising:

a housing having an outer surface and sidewalls defining an interior space;

a flat panel heating element positioned in said interior space of said housing and oriented in a first plane and defining a first longitudinal axis of said heating element;

an air duct having an inlet and an outlet, wherein said heating element is positioned within said air duct, whereby air travels through the duct from said inlet to said outlet;

an air displacement device positioned adjacent to said heating element, said air displacement device creating a substantially planar flow of air which travels along said first plane of said heating panel in said air duct, said air displacement device comprising a fan assembly including a motor having a shaft attached to a fan blade, wherein the axis of rotation of the fan blade is substantially perpendicular to said first longitudinal axis of the flat panel heating element and further wherein said axis of rotation of the fan blade is in a substantially parallel plane to said first plane of said flat panel heating element; and a control circuit electrically coupled to the heating element to control power supplied to said heating element and said air displacement device.

* * * * *

UNITED STATES PATENT AND TRADEMARK OFFICE

CERTIFICATE OF CORRECTION

PATENT NO. : 6,480,672 B1
DATED : November 12, 2002
INVENTOR(S) : Rosenzweig et al.

It is certified that error appears in the above-identified patent and that said Letters Patent is hereby corrected as shown below:

Title page, Item [54] and Column 1, Line 1,
Reads "FLAT PANEL HEATER", should read -- FLAT PANEL HEATER WITH VARYING POWER DENSITY AND FORCED AIRFLOW --

Item [74], *Attorney, Agent or Firm*, reads, "Hoffman & Baron, LLP; Francis E. Marino", should read -- Hoffmann & Baron, LLP; Francis E. Marino --

Signed and Sealed this

Twenty-seventh Day of May, 2003

JAMES E. ROGAN
*Director of the United States Patent and Trademark Office*